US009617991B2

(12) United States Patent
Friedman

(10) Patent No.: US 9,617,991 B2
(45) Date of Patent: Apr. 11, 2017

(54) HOLLOW GEROTOR

(71) Applicant: Parker-Hannifin Corporation, Cleveland, OH (US)

(72) Inventor: Richard T. Friedman, Lexington, MA (US)

(73) Assignee: Parker-Hannifin Corporation, Cleveland, OH (US)

( * ) Notice: Subject to any disclaimer, the term of this patent is extended or adjusted under 35 U.S.C. 154(b) by 210 days.

(21) Appl. No.: 14/373,567

(22) PCT Filed: Jan. 21, 2013

(86) PCT No.: PCT/US2013/022412

§ 371 (c)(1),
(2) Date: Jul. 21, 2014

(87) PCT Pub. No.: WO2013/110037

PCT Pub. Date: Jul. 25, 2013

(65) Prior Publication Data

US 2014/0369879 A1 Dec. 18, 2014

Related U.S. Application Data

(60) Provisional application No. 61/588,382, filed on Jan. 19, 2012.

(51) Int. Cl.
*F01C 1/14* (2006.01)
*F03C 2/08* (2006.01)
(Continued)

(52) U.S. Cl.
CPC ..... *F04C 2/10* (2013.01); *F04C 2/084* (2013.01); *F04C 2/102* (2013.01);
(Continued)

(58) Field of Classification Search
CPC ..... F04C 2/10; F04C 2/084; F04C 2/102
(Continued)

(56) References Cited

U.S. PATENT DOCUMENTS 3,126,755 A * 3/1964 Luck ..... F02B 53/00 418/171
3,139,835 A 7/1964 Wilkinson
(Continued)

FOREIGN PATENT DOCUMENTS

CN 1208818 A 2/1999
DE 14 28 052 A1 12/1968
(Continued)

OTHER PUBLICATIONS

International Search Report for corresponding international patent application No. PCT/US2013/022412 dated Mar. 11, 2014.

*Primary Examiner* — Deming Wan
(74) *Attorney, Agent, or Firm* — Renner, Otto, Boisselle & Sklar, LLP

(57) ABSTRACT

Provided is a hollow rotor and method for making a hollow rotor for a gerotor system, the gerotor system including inner and outer rotors having interengaging lobed profiles. At least one of the inner or outer rotors comprises the hollow rotor, the hollow rotor including radially inner and outer walls radially spaced-apart in relation to a rotational axis of the rotor and walls extending between the radially inner and outer walls for closing axial ends of the hollow rotor. The radially inner and outer walls define therebetween a cavity, thus providing for a hollow or empty interior of the hollow rotor. At least one of the radially inner or outer walls forms a plurality of lobes circumferentially spaced-apart around the cavity.

15 Claims, 13 Drawing Sheets

(51) Int. Cl.

| | |
|---|---|
| ***F04C 2/077*** | (2006.01) |
| ***F04C 18/077*** | (2006.01) |
| ***F01C 1/077*** | (2006.01) |
| ***F01C 1/063*** | (2006.01) |
| ***F16N 13/20*** | (2006.01) |
| ***F04C 2/10*** | (2006.01) |
| ***F04C 2/08*** | (2006.01) |

(52) U.S. Cl.
CPC .... *F04C 2230/10* (2013.01); *F04C 2230/231* (2013.01); *Y10T 29/49236* (2015.01)

(58) Field of Classification Search
USPC ..... 418/171, 166, 131, 132, 1, 61.3
See application file for complete search history.

(56) References Cited

U.S. PATENT DOCUMENTS

| | | | | |
|---|---|---|---|---|
| 5,895,210 | A * | 4/1999 | Nakaniwa | F01C 1/18 418/179 |
| 7,726,959 | B2 * | 6/2010 | Holtzapple | F01C 1/103 418/171 |
| 2004/0101427 | A1 | 5/2004 | Yu et al. | |

FOREIGN PATENT DOCUMENTS

| | | | |
|---|---|---|---|
| EP | 1 462 653 | A1 | 9/2004 |
| JP | H08 296569 | A | 11/1996 |
| RU | 2283442 01 | | 9/2006 |
| RU | 2329368 01 | | 7/2008 |
| WO | 2007/098580 | A1 | 9/2007 |

* cited by examiner

HOLLOW GEROTOR

RELATED APPLICATIONS

This application is a national phase if International Application No. PCT/US2013/022414 filed Jan. 21, 2013 and published in the English language, which claims the benefit of U.S. Provisional Application No. 61/588,338 filed Jan. 19, 2012, and which is are each hereby incorporated herein by reference.

FIELD OF INVENTION

The present invention relates generally to a gerotor system, and more particularly to a hollow rotor and method for making a hollow rotor for a gerotor system.

BACKGROUND

Hydraulic systems such as engines, pumps and compressors include fuel pumps and heat exchangers, and are used for consumer and commercial products, industrial processes, and systems for vehicles. One example of a fuel pump used in a turbine engine is a gerotor pump or gerotor-type pump. The system may contain fewer parts, including fewer seals often needing frequent replacement. Further, gerotor pumps have the ability to operate at high speeds, operate in either direction, and can be made to operate with one direction of flow with either rotation.

Gerotor pumps often include two rotating rotors, an outer rotor and an inner rotor. The outer rotor is disposed about and interengages with the inner rotor. These rotors often operate at high temperatures and pressures where structural integrity is an important factor.

SUMMARY OF INVENTION

The present invention provides a hollow rotor and method for making a hollow rotor for a gerotor system, the gerotor system including inner and outer rotors. At least one of the inner or outer rotors comprises the hollow rotor, which includes inner and outer walls radially spaced-apart, walls closing axial ends of the hollow rotor, and a cavity defined therebetween, thus making the rotor hollow. One of the inner or outer walls forms a plurality of lobes or teeth for interengaging with a plurality of lobes or teeth of the other of the inner or outer rotor.

According to one aspect of the invention, the present invention provides a hollow rotor for a gerotor system. The hollow rotor includes radially inner and outer walls radially spaced-apart in relation to a rotational axis of the rotor, the radially inner and outer walls defining therebetween a cavity, and at least one of the radially inner or outer walls forming a plurality of lobes circumferentially spaced-apart around the cavity. Axial ends of the cavity are closed by respective walls extending between the radially inner and outer walls.

The cavity may be enclosed on all sides.

The hollow rotor may be made of steel.

The at least one of the radially inner and outer walls forming a plurality of circumferentially spaced-apart lobes may be substantially trochoidal.

A gerotor system may include inner and outer rotors having respective lobed surfaces, the respective lobed surfaces for interengaging with one another, wherein at least one of the inner or outer rotors is the hollow rotor.

The inner and outer rotors of the gerotor system may be rotatable with respect to one another, thereby creating alternately expanding and contracting pockets between the interengaging lobed surfaces and providing for movement of fluid through the system.

The outer rotor of the gerotor system may be the hollow rotor, the inner wall of the outer rotor forming a plurality of circumferentially spaced-apart lobes.

The inner rotor of the gerotor system may be the hollow rotor, the outer wall of the inner rotor forming a plurality of circumferentially spaced-apart lobes. The inner rotor may be a first hollow rotor and the outer rotor may be a second hollow rotor, wherein the inner wall of the outer rotor forms a plurality of circumferentially spaced-apart lobes, and the outer wall of the inner rotor forms a plurality of circumferentially spaced-apart lobes.

A portion of the lobed surface of the inner rotor of the gerotor system may engage a portion of the lobed surface of the outer rotor while the gerotor system is active.

The inner rotor of the gerotor system may be axially located with respect to the outer rotor through a rolling or sliding interaction between the lobed surfaces of the inner and outer rotors.

The inner rotor of the gerotor system may rotate about a first axis and the outer rotor rotates about a second axis.

According to another aspect of the invention, the present invention provides a hollow rotor for a gerotor system. The hollow rotor includes radially spaced-apart first and second ring portions, the first ring portion radially disposed about the second ring portion, wherein at least one of the ring portions has a substantially lobed profile. The hollow rotor also includes front and rear faceplate portions. The hollow rotor further includes a cavity defined by the first and second ring portions and the front and rear faceplate portions.

The first and second ring portions and front and rear faceplate portions may be interconnected to define a sealed enclosure.

According to a method of making a hollow rotor of the present invention, the method includes connecting an inner member having an outer surface and an outer member having an inner surface, which when the outer member is assembled to the inner member the inner and outer surfaces are radially spaced-apart to define therebetween a cavity. The method further includes removing material from the inner or outer member to form an inner or outer wall of the hollow rotor, the inner or outer wall of the hollow rotor forming a plurality of circumferentially spaced-apart lobes.

At least one of the outer surface of the inner member or the inner surface of the outer member may form a plurality of circumferentially spaced-apart lobes.

Removing material from the inner or outer member may include removing a portion of the inner or outer member extending from a front face portion to a rear face portion of the inner or outer member.

The inner and outer members may be connected by welding, soldering, brazing, or bonding.

Material may be removed by electrical discharge machining or wire electrical discharge machining.

At least one the inner or outer members may include a passage extending from a front face portion to a rear face portion of the at least one the inner or outer members.

Connecting the inner member and the outer member may include receiving the inner member at the outer member, the outer member having an open end having a profile corresponding to a profile of the inner member.

The inner member may further include first and second connected sections, the first and second sections having respective first and second profiles, and wherein the outer member further comprises first and second open ends for receiving the first and second sections, the first and second open ends having respective first and second profiles corresponding to the first and second profiles of the first and second sections, respectively.

The foregoing and other features of the invention are hereinafter described in greater detail with reference to the accompanying drawings.

DETAILED DESCRIPTION

The principles of the present application have general application to gerotor systems, and particular application to a hollow rotor and method of making a hollow rotor for gerotor systems or gerotor-type systems, and thus will be described below chiefly in this context. The hollow rotor may be used in gerotor systems for hydraulic systems such as engines, pumps, motors and/or compressors. For example, the hollow rotor may be suitable for gerotor systems in vehicles, such as fuel injection systems in aircrafts and watercrafts. It will of course be appreciated, and also understood, that the principles of the invention may be useful in other applications, in particular, in non-gerotor-type systems such as vane pumps or gear motors.

Figure 1:
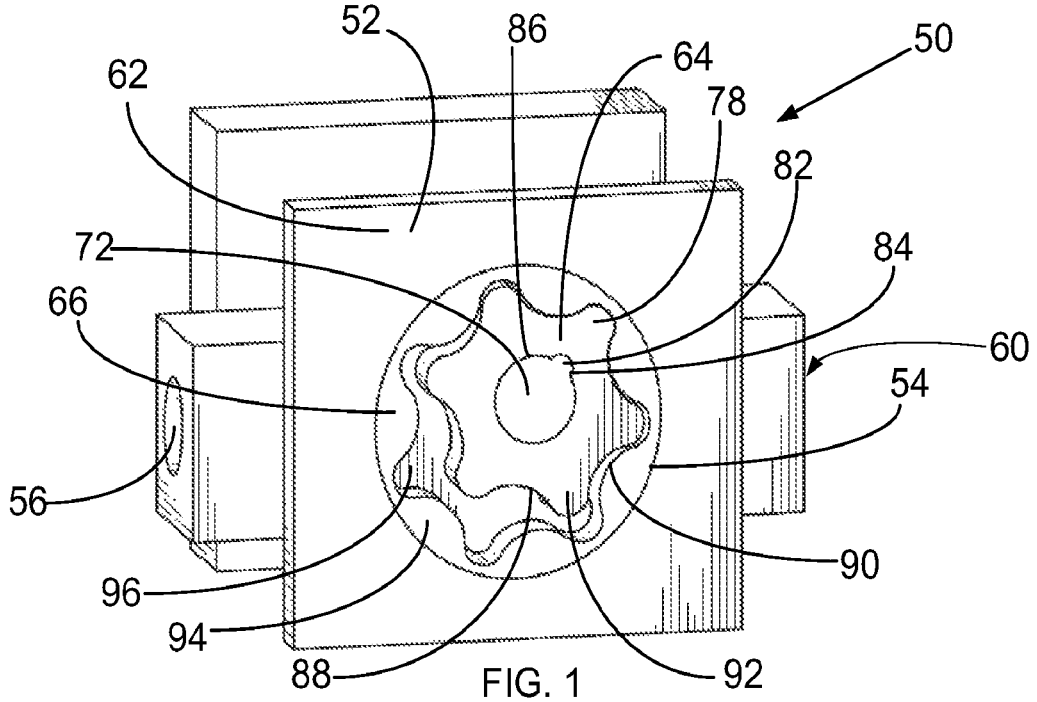
FIG. 1 is a perspective view of a gerotor system.
Figure 2:
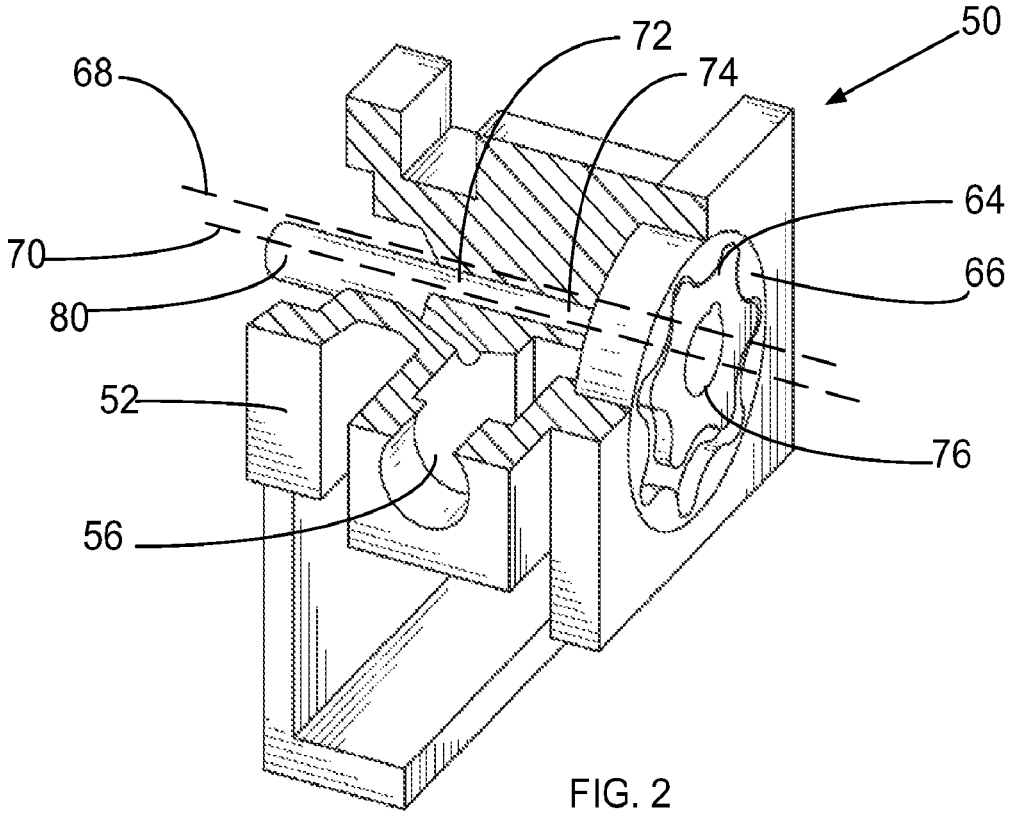
FIG. 2 is a fragmentary cross-sectional view of the gerotor system of FIG. 1.

Referring now in detail to the drawings and initially to FIGS. 1 and 2, a gerotor system is indicated generally at reference numeral 50. The gerotor system 50 includes a body portion 52 having a chamber 54 disposed therein between first and second passages 56 and 60. The chamber 54 provides for flow or fluid communication, such as gaseous communication or liquid communication, between the passages 56 and 60. The chamber 54 is enclosed at a front face 62 of the body portion 52 by an end plate (not shown).

Disposed within the chamber 54 are two gears, such as inner rotor 64 and outer rotor 66. The inner and outer rotors 64 and 66 may be made of any suitable material, such as steel, aluminum, titanium, ceramic, plastic, etc. The inner rotor 64 is radially disposed within the outer rotor 66 for engaging with the outer rotor 66. At least one of the inner rotor 64 or the outer rotor 66 are rotatable with respect to the other of the inner or outer rotors 64 and 66. As shown, the inner rotor 64 may rotate about a first axis 68 and the outer rotor 66 may rotate about a second axis 70 parallel to the first axis 68.

Located at the first axis 68 is a shaft 72 having a first end 74 axially disposed within a central opening 76 of the inner rotor 64. The central opening 76 extends axially through the inner rotor 64 from a front face 78 to a rear face (not shown). A second end 80 of the shaft 72 is connected to a motor or other power source (not shown) for driving the shaft 72 about the first axis 68.

A notch 82 extends axially along at least a portion of the first end 74 of the shaft 72. The notch 82 engages with a notch pocket 84 of the inner rotor 64. The notch pocket 84 is defined by at least a portion of an inner surface 86 of the central opening 76 of the inner rotor 64. Engagement of the notch 82 with the notch pocket 84 provides for transfer of driving motion from the shaft 72 to the inner rotor 64. It will also be appreciated that the shaft 72 may include multiple notches 82 and the inner rotor 64 may include multiple notch pockets 84, or alternatively, the shaft 72 may not include a notch and the inner rotor 64 may not include a notch pocket. Further, the shaft 72 and/or the inner rotor 64 may include threads, holes, ridges, pockets, keys, or other features in combination with or without mechanical components such as nuts, clips, rods, or springs for connecting the shaft 72 and the inner rotor 64.

As the inner rotor 64 is driven by the shaft 72, the inner rotor 64 engages with the outer rotor 66. The inner rotor 64 has an outer lobed surface 88 having a cyclic profile, such as a substantially lobed or trochoidal profile, for engaging with an inner lobed surface 90 of the inner rotor 64, the inner lobed surface 90 also having a cyclic profile, such as a substantially lobed or trochoidal profile. The inner and outer rotors 64 and 66 are axially located with respect to one another through a rolling interaction, such as a sliding interaction, between the lobed profiles of the inner and outer rotors 64 and 66.

The lobed profile of the outer surface 88 of the inner rotor 64 is defined by a plurality of teeth of the inner rotor 64, such as lobes 92. The lobes 92 interengage with a plurality of teeth of the outer rotor 66, such as lobes 94, defining the lobed profile of the inner surface 90 of the outer rotor 66. As shown, the lobes 92 are equally spaced-apart around the circumference of the outer surface 88 allowing for efficient interengagement with the lobes 94, equally spaced-apart around the circumference of the inner surface 90. It will be appreciated that the inner and outer rotors 64 and 66 may have any suitable number of lobes. It will also be appreciated that more interengaging lobes 92 and 94 may allow for increased throughput of an associated gerotor system, such as the gerotor system 50.

When the gerotor system 50 is active, the motor or other power source (not shown) causes the shaft 72 to rotate, thereby transferring driving motion, such as rotational motion, to the inner rotor 64, causing it rotate relative to the outer rotor 66. It will be appreciated that the inner rotor 64 may rotate or orbit and the outer rotor 66 may not rotate or orbit. Alternatively, depending on the application, the gerotor system 50 may operate such that the outer rotor 66 may be rotated via a drive system (not shown), which may include bearings, gears, belts, pulleys, shafts, or other components, such as mechanical or electrical components, for rotating the outer rotor 66. In the case that the gerotor system 50 operates such that both the inner and outer rotors 64 and 66 rotate or orbit, it will be appreciated that the inner rotor 64 may rotate or orbit in the same direction as the outer rotor 66.

The rotation of at least one of the inner rotor 64 or the outer rotor 66 relative to the other of the inner rotor 64 or the outer rotor 66 causes the lobes 92 to interengage with the lobes 94. The interengagement creates alternately expanding and contracting sub-chambers, such as pockets 96, between the outer lobed surface 88 of the inner rotor 64 and the inner lobed surface 90 of the outer rotor 66. The interengagement also forms a seal equidistant between the first and second passages 56 and 60 due to close tolerancing of the outer surface 88 of the inner rotor 64 and the inner surface 90 of the outer rotor 66.

Rotation of at least one of the inner rotor 64 or the outer rotor 66 in combination with the seal causes fluid, such as liquid, gas, or a combination thereof, to enter or exit the chamber 54. Particularly, the close tolerancing between the rotors 64 and 66 causes volume displacement between the interengaging lobes 92 and 94 and pockets 96, thereby causing pressure to build. The volume displacement causes fluid to be suctioned through one of the first passage 56 or the second passage 60 into the chamber 54, and then forced out of the chamber 54 through the other of the first passage 56 or the second passage 60. Depending on the application of the gerotor system or rotational direction of the rotors 64 and 66, the first passage 56 may serve as an inlet and the second passage 60 may serve as an outlet, or vice versa. Additionally, due to the close tolerancing between the rotors 64 and 66, the gerotor system 50 may operate such that the rotors 64 and 66 do not touch, while still allowing adequate volume displacement between the rotors 64 and 66 to provide for fluid communication and/or fluid flow between the first and second passages 56 and 60.

Figure 3:
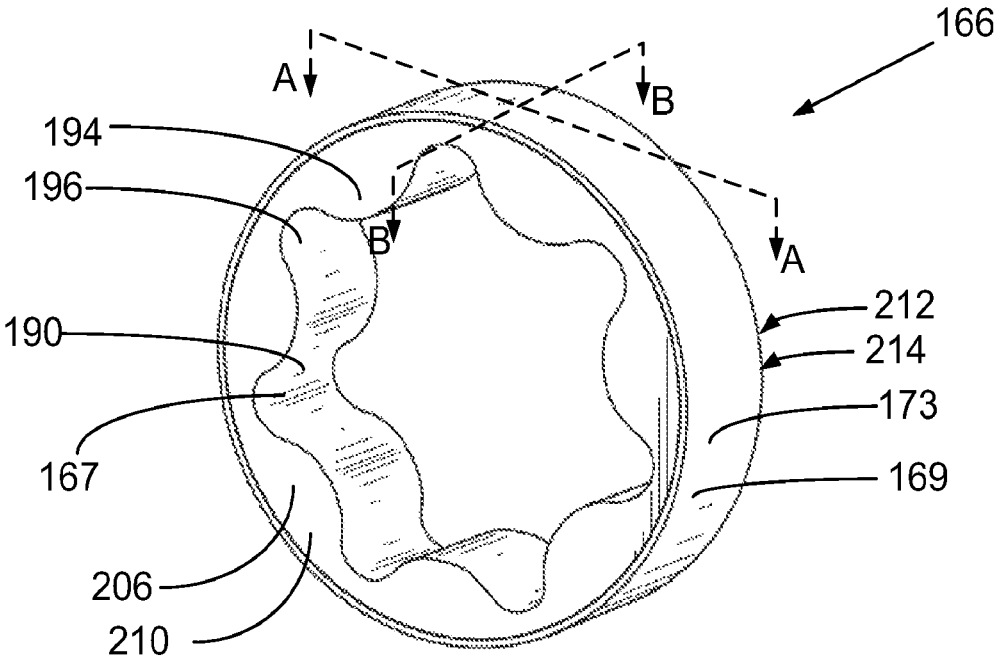
FIG. 3 is a perspective view of an exemplary hollow outer rotor according to the present invention.
Figure 4:
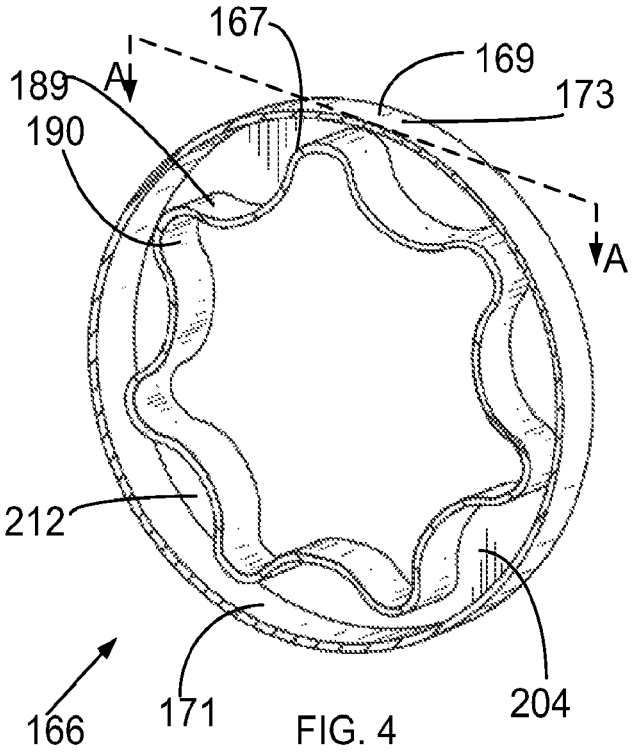
FIGS. 4 and 5 are cross-sectional views of the hollow outer rotor of FIG. 3.
Figure 5:
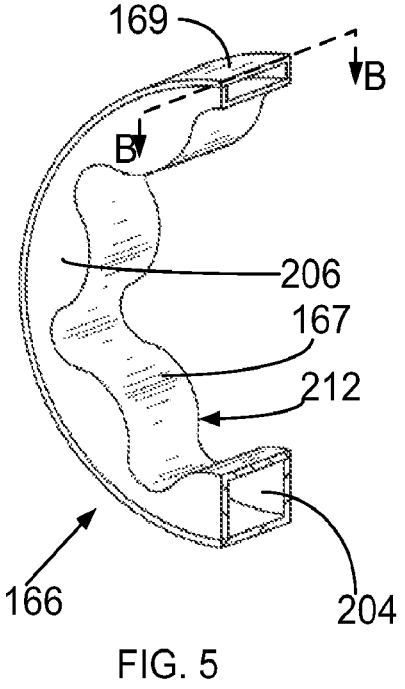

Turning now to FIGS. 3-5, a hollow outer rotor is shown at 166. The hollow outer rotor 166 is an exemplary embodiment the above-referenced outer rotor 66 of the gerotor system 50, and consequently the same reference numerals but indexed by 100 are used to denote structures of the hollow outer rotor 166 corresponding to similar structures of the outer rotor 66. In addition, the foregoing description of the outer rotor 66 is equally applicable to the hollow outer rotor 166 except as noted below.

The hollow outer rotor 166 includes inner and outer ring portions, such as radially inner wall 167 and radially outer wall 169, radially spaced-apart in relation to a rotational axis of the hollow outer rotor 166. As shown, the inner and outer walls 167 and 169 have substantially the same thickness, although it will be appreciated that the inner and outer walls 167 and 169 may have varying thicknesses. The inner wall 167 has a cyclic profile, such as a substantially lobed or trochoidal profile, and includes an inner surface 189 and an outer surface 190. The inner and outer surfaces 189 and 190 define a plurality of circumferentially spaced-apart lobes 194 and recesses 196 disposed between the lobes 194. The outer wall 169 has a substantially circular profile and includes an inner surface 171 and an outer surface 173.

A cavity 204 is defined between the inner and outer walls 167 and 169, providing for a hollow or empty interior of the hollow outer rotor 166. The lobes 194 are circumferentially spaced-apart around the cavity 204. Axial ends of the cavity 204 are closed by respective front and rear faceplate portions, such as front wall 206 defining a front face 210 of the rotor 166 and rear wall 212 defining a rear face 214 of the rotor 166. It will be appreciated that the cavity 204 may be filled with foam, such as a lightweight foam, or a fluid, such as air.

The inner and outer walls 167 and 169 and front and rear walls 206 and 212 interconnect. The interconnection defines a sealed enclosure, enclosing the cavity 204 on all sides, as shown in the cross-sectional views of the hollow outer rotor 166 in FIGS. 4 and 5, taken about the lines A-A and B-B, respectively. It will be appreciated that at least one of the inner wall 167, the outer wall 169, the front wall 206, or the rear wall 212 may include an opening (not shown) allowing fluid communication between the cavity 204 and an external environment. Alternatively, the hollow outer rotor 166 may include only a subset of the inner, outer, front, and rear walls 167, 169, 206, and 212 providing for the cavity 204 to be open to an external environment.

Figure 6:
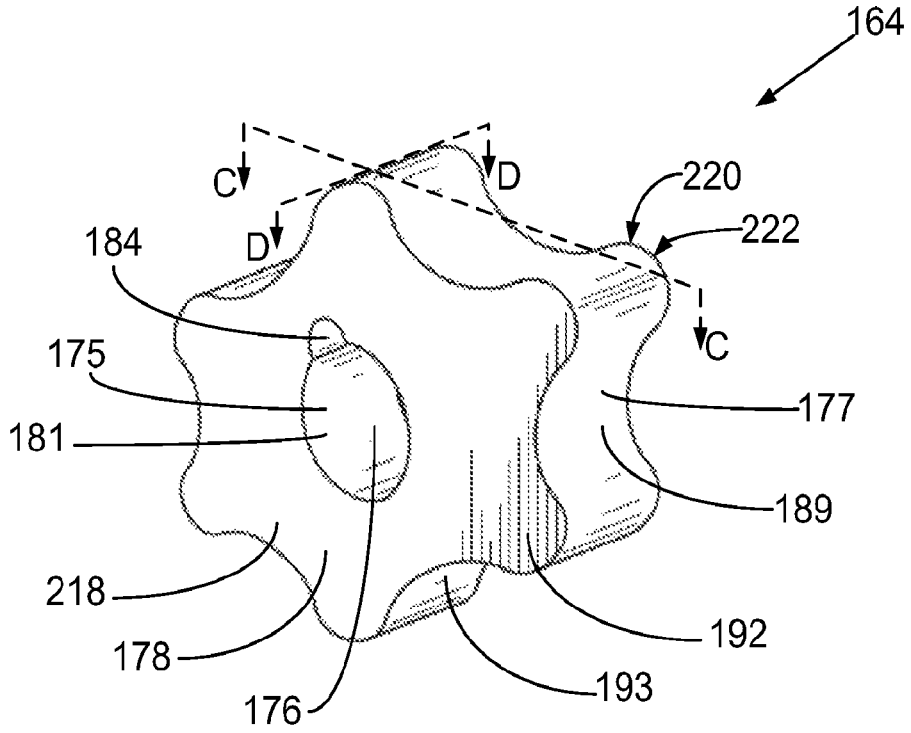
FIG. 6 is a perspective view of an exemplary hollow inner rotor according to the present invention.
Figure 7:
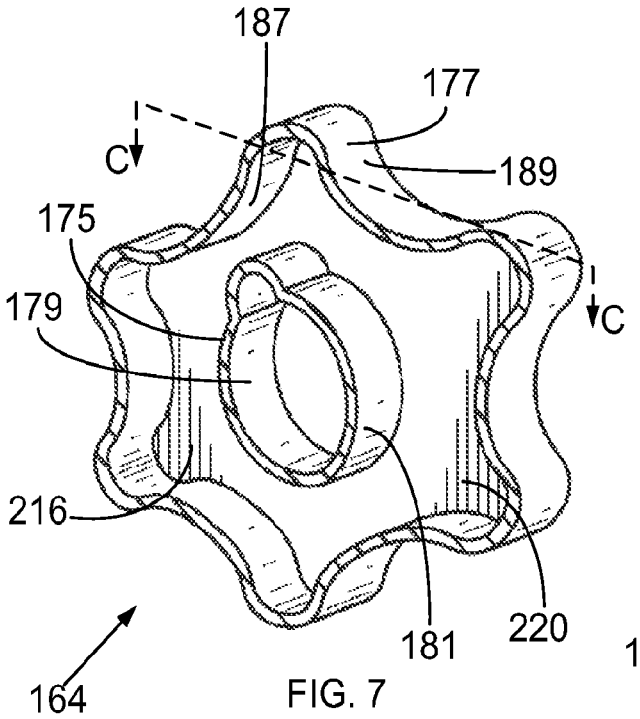
FIGS. 7 and 8 are cross-sectional views of the hollow inner rotor of FIG. 6.
Figure 8:
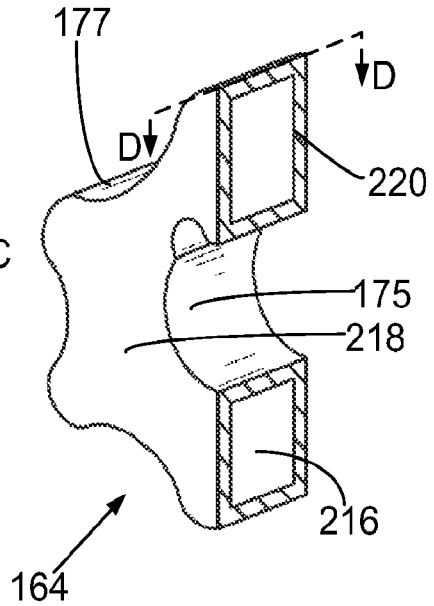

Turning next to FIGS. 6-8, a hollow inner rotor is shown at 164. The hollow inner rotor 164 is an exemplary embodiment the above-referenced inner rotor 64 of the gerotor system 50, and consequently the same reference numerals but indexed by 100 are used to denote structures of the hollow inner rotor 164 corresponding to similar structures of the inner rotor 64. In addition, the foregoing description of the inner rotor 64 is equally applicable to the hollow inner rotor 164 except as noted below.

The hollow inner rotor 164 includes inner and outer ring portions, such as radially inner wall 175 and radially outer wall 177, radially spaced-apart in relation to a rotational axis of the hollow inner rotor 164. As shown, the inner and outer walls 175 and 177 have substantially the same thickness, although it will be appreciated that the rotor 164 may include the inner and outer walls 175 and 177 having varying thicknesses. The inner wall 175 has a substantially circular profile and includes an inner surface 179 and an outer surface 181. The inner wall 175 also includes a notch profile defining a notch pocket 184 for engaging with a notch of a drive shaft such as the notch 82 of shaft 72 (FIGS. 1 and 2). The outer wall 177 has a cyclic profile, such as a substantially lobed or trochoidal profile, and includes an inner surface 187 and an outer surface 189. The inner surface 187 and outer surface 189 define a plurality of circumferentially spaced-apart lobes 192 and recesses 193 disposed between the lobes 192.

A cavity 216 is defined between the inner and outer walls 175 and 177, providing for a hollow or empty interior of the hollow inner rotor 164. The lobes 192 are circumferentially spaced-apart around the cavity 216. Axial ends of the cavity 216 are closed by respective front and rear faceplate portions such as front wall 218 defining a front face 178 of the rotor 164 and rear wall 220 defining a rear face 222 of the rotor 164. It will be appreciated that the cavity 216 may be filled with foam, such as a lightweight foam, or a fluid, such as air. A central opening 176 extends axially through the rotor 164 from the front face 178 to the rear face 222. The central opening 176 is defined by the radially inner wall 175 and includes the notch pocket 184.

Figure 9:
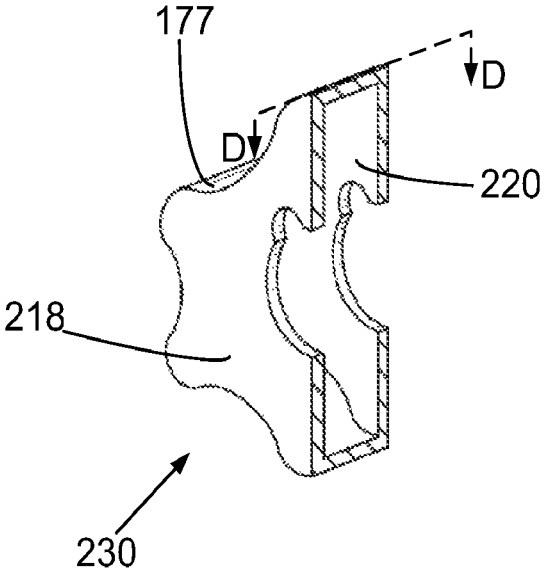
FIG. 9 is a cross-sectional view of another exemplary hollow inner rotor.

The inner and outer walls 175 and 177 and front and rear walls 218 and 220 interconnect. The interconnection defines a sealed enclosure, enclosing the cavity 216 on all sides, as shown in the cross-sectional views of the hollow inner rotor 164 in FIGS. 7 and 8, taken about lines C-C and D-D, respectively. It will be appreciated that at least one of the inner wall 175, the outer wall 177, the front wall 218, or the rear wall 220 may include an opening (not shown) allowing fluid communication between the cavity 216 and an external environment. Alternatively, other embodiments of the hollow inner rotor 164 may include only a subset of the inner, outer, front, and rear walls 175, 177, 218, and 220 providing for the cavity 216 to be open to an external environment. For example, FIG. 9 shows an exemplary embodiment of the hollow inner rotor at 230 including only outer, front, and rear walls 177, 218, and 220.

Figure 10:
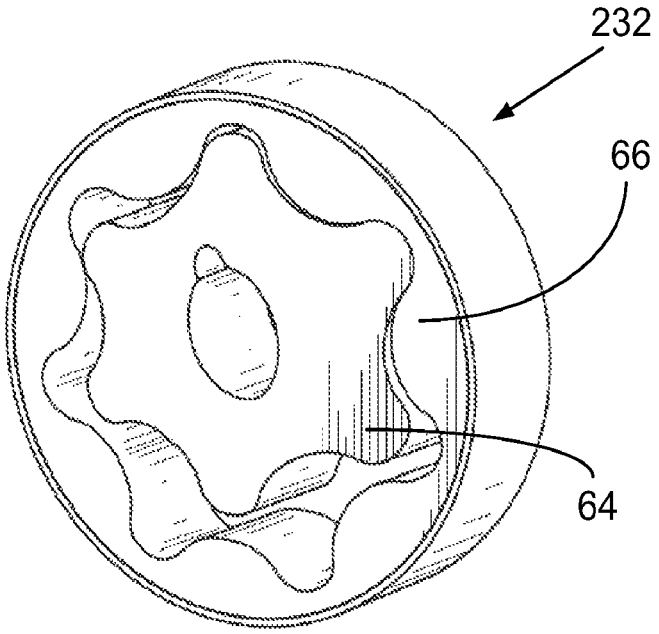
FIG. 10 is a perspective view of the hollow outer rotor of FIG. 3 and the hollow inner rotor of FIG. 6.

Turning now to FIG. 10, a gerotor subassembly for use with a gerotor system, such as gerotor system 50, is shown at 232. The gerotor subassembly 232 includes the outer rotor 66 and the inner rotor 64. It will be appreciated that depending on the use of the gerotor system including the gerotor subassembly 232, the outer and inner rotors 64 and 66 may be the hollow outer and inner rotors 164 and 166. Alternatively, only the outer rotor 66 may be the hollow outer rotor 166 or only the inner rotor 64 may be the hollow inner rotor 164. A gerotor subassembly including at least one of the hollow inner rotor 164 or the hollow outer rotor 166 may have the advantages of being lightweight and having substantial structural integrity. Accordingly, such a gerotor assembly may be suitable for weight-sensitive hydraulic systems operating with high pressures and temperatures, such as fuel injection systems of aircrafts. The gerotor system may also be suitable for clean, low pressure applications such as lubrication systems or hot oil filtration systems.

Turning next to FIGS. 11-19, exemplary steps for making the hollow outer rotor 166 are shown therein. The method described may have the advantages of easy handling and gripping of components and also efficient heat absorption, thereby resulting in optimal strength and integrity of the hollow outer rotor 166.

Figure 11:
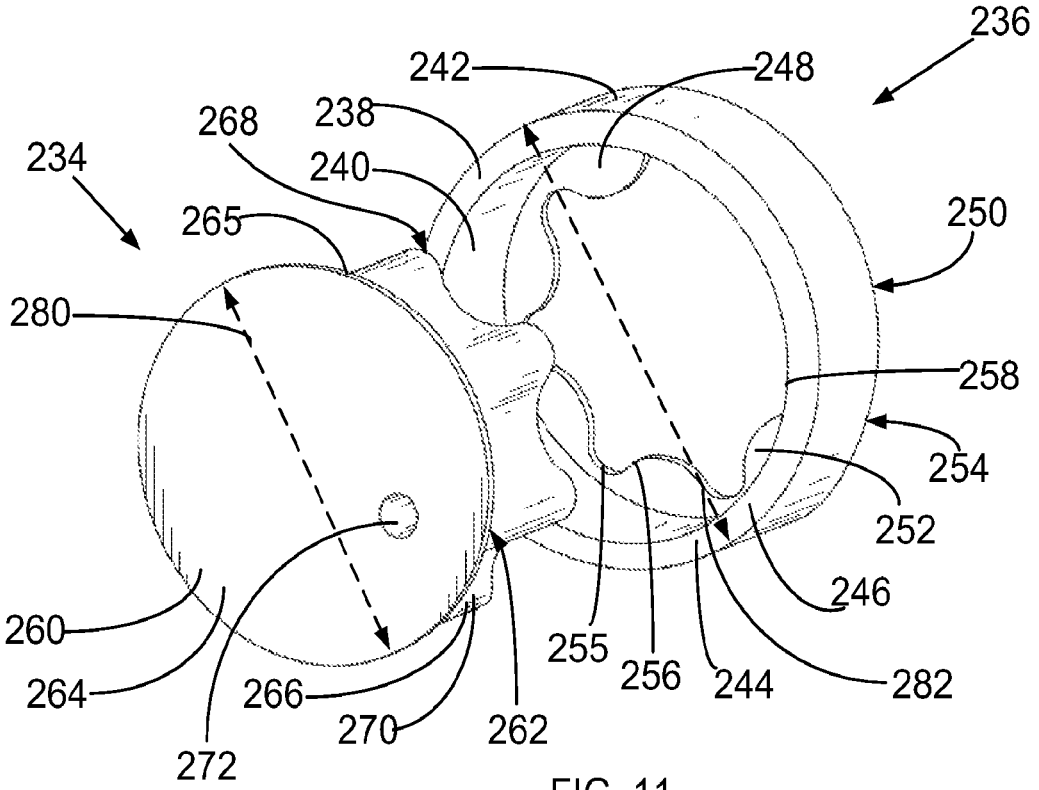
FIG. 11 is a perspective view of an inner member and an outer member that form the hollow outer rotor.

Referring now to FIG. 11, an inner member 234 and an outer member 236 used to form the hollow outer rotor 166 are shown. The inner and outer members 234 and 236 may be cast, molded, machined from larger blocks of a suitable material, such as steel, or otherwise formed by any other suitable method of construction.

The outer member 236 includes a ring portion, such as a wall portion 238 having an inner surface 240 and an outer surface 242. Disposed between and adjacent to the inner and outer surfaces 240 and 242 at a first axial end 244 of the wall portion 238 is a face surface 246. A faceplate portion 248 extends radially inwardly from a second axial end 250 of the wall portion 238. The faceplate portion 248 includes an inner surface 252, an outer surface 254, and an edge surface 255 defined between the inner and outer surfaces 252 and 254. The faceplate portion 248 also includes a first opening 256 defined by the edge surface 255 and having a cyclic profile, such as a substantially lobed or trochoidal profile. A second opening 258 defined by the inner surface 240 and having a substantially circular profile is provided at the second axial end 250 of the wall portion 238.

The inner member 234 includes a faceplate portion 260 having a substantially circular profile corresponding to the substantially circular profile of the second opening 258 of the outer member 236. The faceplate portion 260 has an inner surface 262, an outer surface 264, and an edge surface 265 defined between the inner and outer surfaces 262 and 264. A core portion 266 extends axially from the inner surface 262 of the faceplate portion 260. The core portion 266 has a cyclic profile, such as a substantially lobed or trochoidal profile, corresponding to the substantially lobed or trochoidal profile of the first opening 256 of the outer member 236. The core portion 266 has a face surface 268 and an edge surface 270 adjacent to the face surface 268. An indexing passage 272 extends axially through the inner member 234 from the outer surface 264 of the faceplate portion 260 to the face surface 268 of the core portion 266. The indexing passage 272 is shown as substantially cylindrical, but may be of any other suitable shape.

Figure 12:
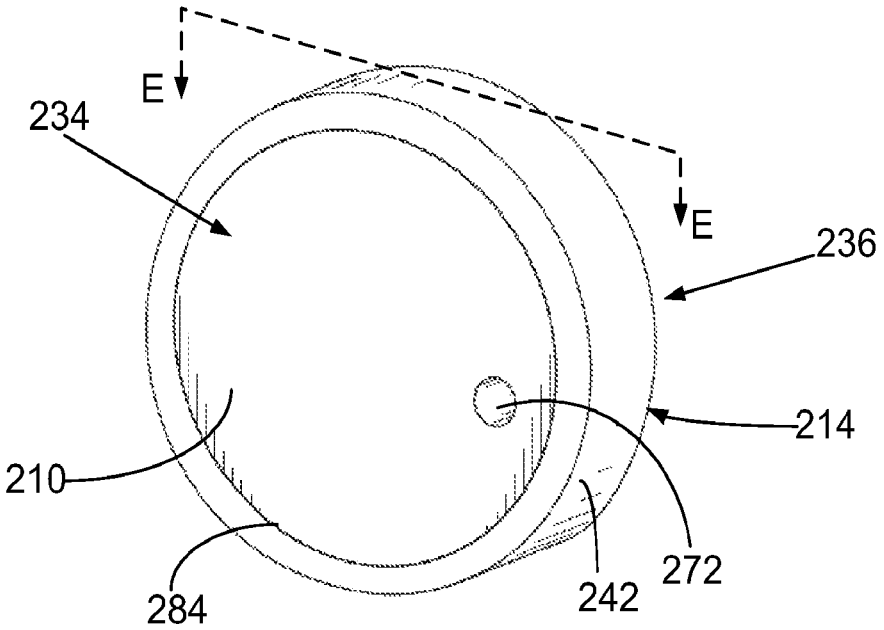
FIG. 12 is another perspective view of the inner and outer members of FIG. 11.

As shown in FIGS. 11 and 12, to form the hollow outer rotor 166, the inner member 234 is received at the outer member 236, such as inserted into the outer member 236, such that the substantially lobed profile of the core portion 266 of the inner member 234 is received into the substantially lobed profile of the first opening 256 of the outer member 236. The edge surface 255 of the faceplate portion 248 is disposed against the edge surface 270 of the core portion 266. The substantially circular profile of the faceplate portion 260 is likewise received into the substantially circular profile of the second opening 258 of the outer member 236. The edge surface 265 of the plate portion 260 is disposed against the inner surface 258 of the wall portion 238.

When the inner and outer members 234 and 236 are connected, the outer surface 264 of the plate portion 260 may be flush to or in the same plane as the face surface 246 and in combination may form one of the front face 210 or the rear face 214 of the hollow outer rotor 166. Likewise, the outer surface 254 may be flush to or in the same plane as the face surface 268 and in combination may form the other of the front face 210 or the rear face 214 of the hollow outer rotor 166. The outer surface 242 extends between the front and rear faces 210 and 214. Alternatively, depending on the outer diameter 280 of the faceplate portion 260 and the outer diameter 282 of the wall portion 238, the faceplate portion 260 may not be received into the second opening 258. Instead, the face surface 246 of the wall portion 238 may be disposed against the inner surface 262 of the faceplate portion 260 once the inner and outer members 234 and 236 are connected. In this case, the outer surface 242 and the edge surface 265 in combination may form an outer surface of the hollow outer rotor 166, and additional welding may be completed on the outer surface.

Figure 13:
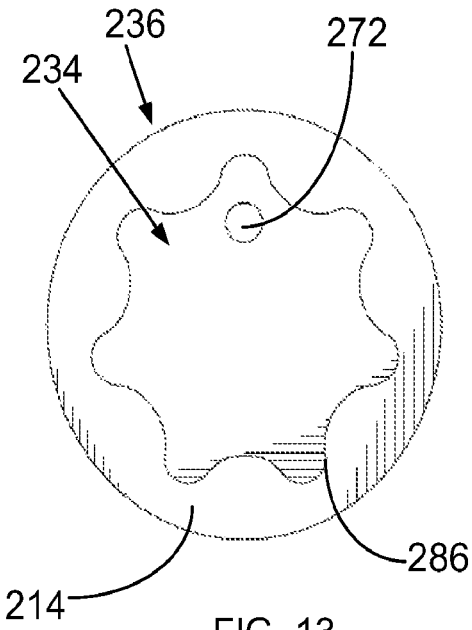
FIGS. 13 and 14 are front and rear views, respectively, of the inner and outer members of FIG. 11.
Figure 14:
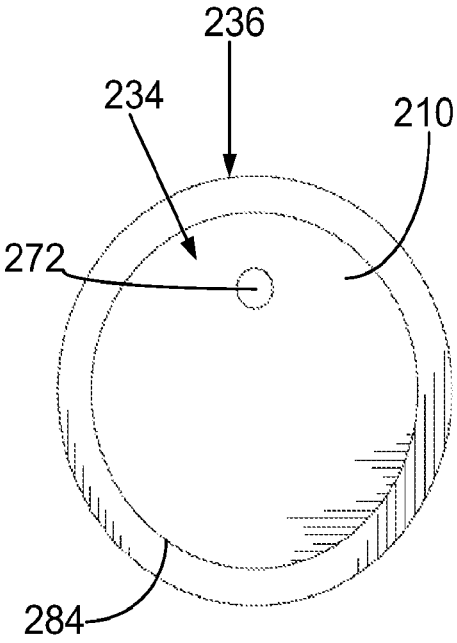

Turning now to FIGS. 12-14, an assembly including the inner and outer members 234 and 236 is shown. The assembly is substantially cylindrical and has a front face 210 and rear face 214, which are the front and rear faces 210 and 214, respectively, of the hollow outer rotor 166. The outer surface 242 is disposed between the front and rear faces 210 and 214. The indexing passage 272 extends axially between the front and rear faces 210 and 214.

Once the inner and outer members 234 and 236 are positioned as shown in FIG. 12, the members are connected at lines 284 and 286 to form a coupled assembly. The members may be coupled at line 284 and 286 in any suitable manner, such as by welding (ultrasonic welding, induction welding, heat welding, friction welding, etc.), brazing, soldering, gluing, melting, bonding, etc. Additional machining, such as sanding or milling, of the surfaces of the assembly may also be completed. It will also be appreciated that other embodiments of the coupled assembly of the inner and outer members 234 and 236 may provide for connecting at lines different than or other than the lines 284 and 286.

Figure 15:
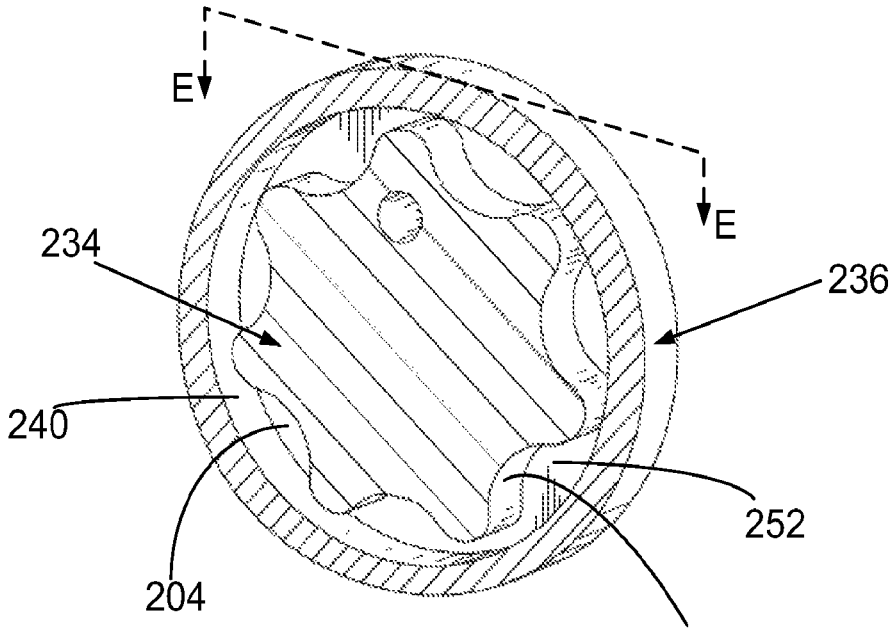
FIG. 15 is a cross-sectional view of the inner and outer members of FIG. 11.

When the inner and outer members are coupled together, the cavity 204 is provided as shown in the cross-section of FIG. 15 taken about line E-E in FIG. 12. The cavity is defined by the inner surface 252, the inner surface 240, the edge surface 270, and the inner surface 262 (not shown).

Figure 16:
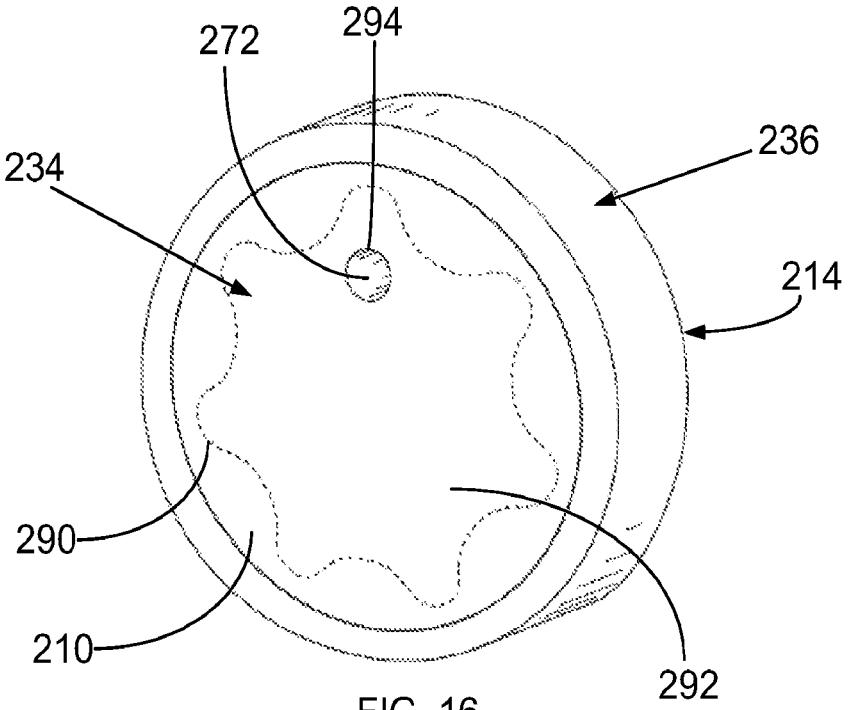
FIG. 16 is still another perspective view of the inner and outer members of FIG. 11.

Turning now to FIG. 16, a dotted line, such as cut line 290, is represented on the front face 210. The cut line 290 represents an outer profile of an inner portion 292 to be removed from the welded assembly. It will be appreciated that the cut line 290 may alternatively be represented on the rear face 214. The inner portion 292 is cyclic in profile, such as substantially lobed or trochoidal in profile, and extends axially between the front and rear faces 210 and 214. As shown, the profile of the inner portion 292 removed at the front face 210 is substantially the same as the profile of the inner portion 292 removed at the rear face 214. Alternatively, the profiles of the inner portion 292 removed at the front and rear faces 210 and 214 may be different. The removing may include milling, laser cutting, electrical discharge machining, wire electrical discharge machining, or any other suitable method of removing material.

In the case of wire electrical discharge machining, or wire-EDM, the cut line 290 is programmed, such as via computer numerically controlled programming or CNC programming, into a memory of a wire-EDM machine. A wire of the wire-EDM machine is passed through the indexing passage 272 such that the wire extends axially away from each of the front and rear faces 210 and 214. Accordingly, the wire-EDM process allows for uniform cuts to be made extending from the front face 210 to the rear face 214. A first cut may extend from an inner surface 294 of the indexing passage 272 to the cut line 290. Subsequent cuts may substantially follow the cut line 290 to thereby remove the inner portion 292.

Figure 17:
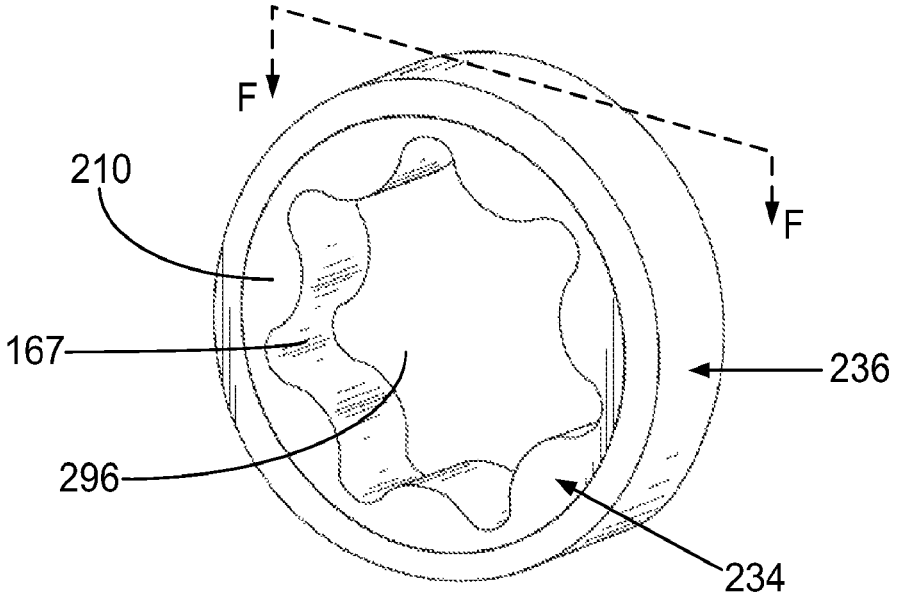
FIG. 17 is a perspective view of the inner and outer members of FIG. 11 after machining.

Referring next to FIG. 17, after the material 292 has been removed, the assembly has a cyclic inner profile, such as a substantially lobed or trochoidal inner profile, defined by the central opening 296. The central opening 296 extends axially between the front and rear faces 210 and 214 of the assembly and corresponds to an outer profile of the inner portion 292 that was removed from the assembly. The resulting inner wall 167 defining the central opening 296 is the inner wall 167 of the hollow outer rotor 166.

Figure 18:
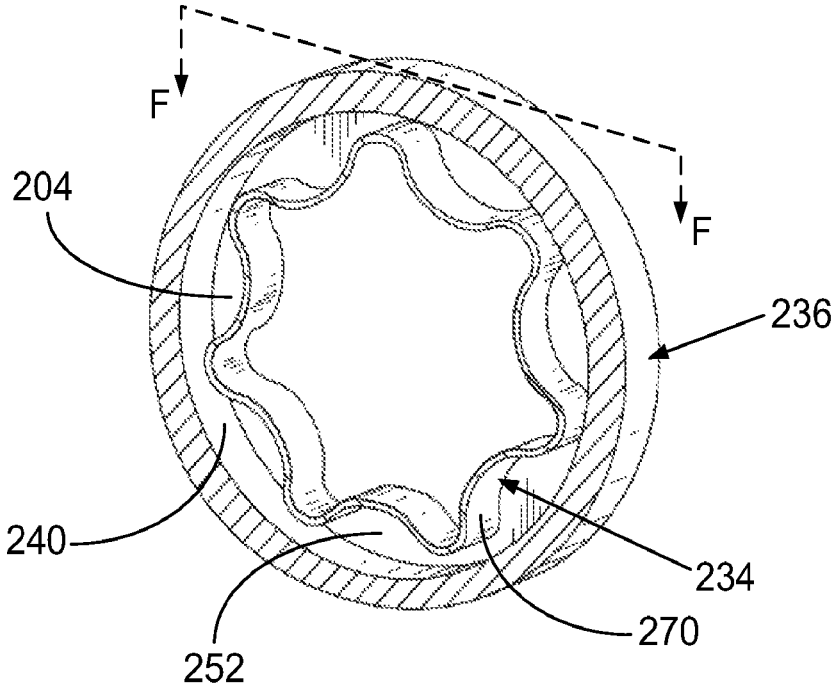
FIG. 18 is a cross-sectional view of the inner and outer members of FIG. 17.

Turning now to FIG. 18, the assembly is shown in cross-section taken about line F-F in FIG. 17. As shown at 204, the cavity is defined by the inner surface 252, the inner surface 240, the edge surface 270, and the inner surface 262 (not shown).

Figure 19:
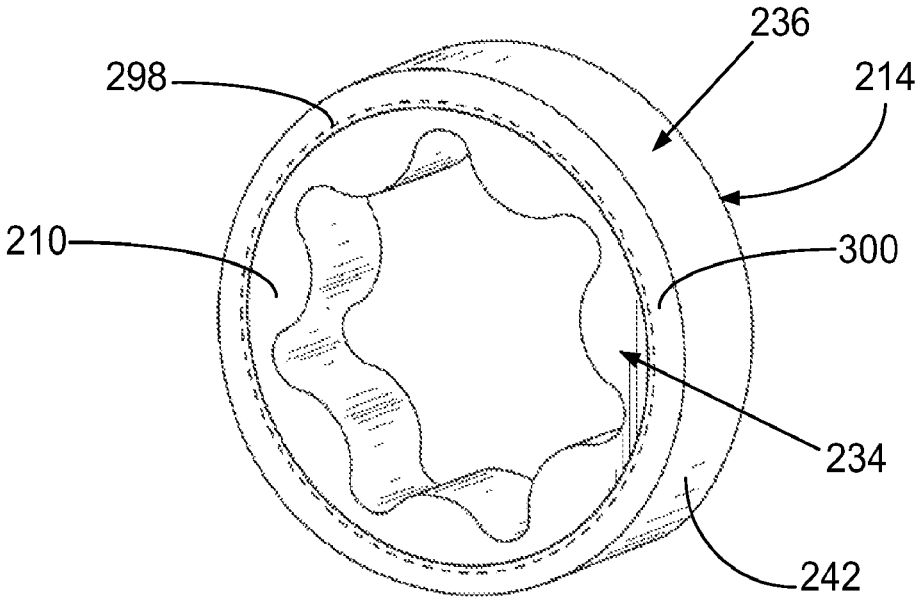
FIG. 19 is another perspective view of the inner and outer members of FIG. 17.

Referring next to FIG. 19, a dotted line, such as cut line 298, is represented on the front face 210. The cut line 298 represents an inner profile of a substantially cylindrically profiled outer portion 300 to be removed from the assembly. It will be appreciated that the cut line 298 may alternatively be represented on the rear face 214. The outer portion 300 to be removed extends axially between the front and rear faces 210 and 214. As shown, the profile of the outer portion 300 removed at the front face 210 is substantially the same as the profile of the outer portion 300 removed at the rear face 214. Alternatively, the profiles of the outer portion 300 removed at the front and rear faces 210 and 214 may be different. The removing may include milling, grinding, laser cutting, lathe cutting, electrical discharge machining, wire electrical discharge machining, etc. In the case of wire electrical discharge machining, or wire-EDM, the cut line 298 is programmed, as described above in reference to the cut line 290, except that the wire may begin at the outer surface 242 instead of at an indexing passage.

After removal of the outer portion 300, the resulting assembly is shown at FIGS. 3-5, described above. Thus, the resulting outer surface of the resulting assembly after removal of the outer portion 300 is defined by the substantially cylindrical cut line 298 and is the outer surface 173 of the hollow outer rotor 166. It will be appreciated that the above-described steps may be completed in any appropriate or suitable order that results in making the hollow outer rotor 166. Further, additional machining or welding, such as sanding or milling, of the surfaces of the assembly may also be completed.

Turning now to FIGS. 20-28, exemplary steps for making the hollow inner rotor 164 are shown therein. The method described may have the advantages of easy handling and gripping of components and also efficient heat absorption, thereby resulting in optimal strength and integrity of the hollow inner rotor 164.

Figure 20:
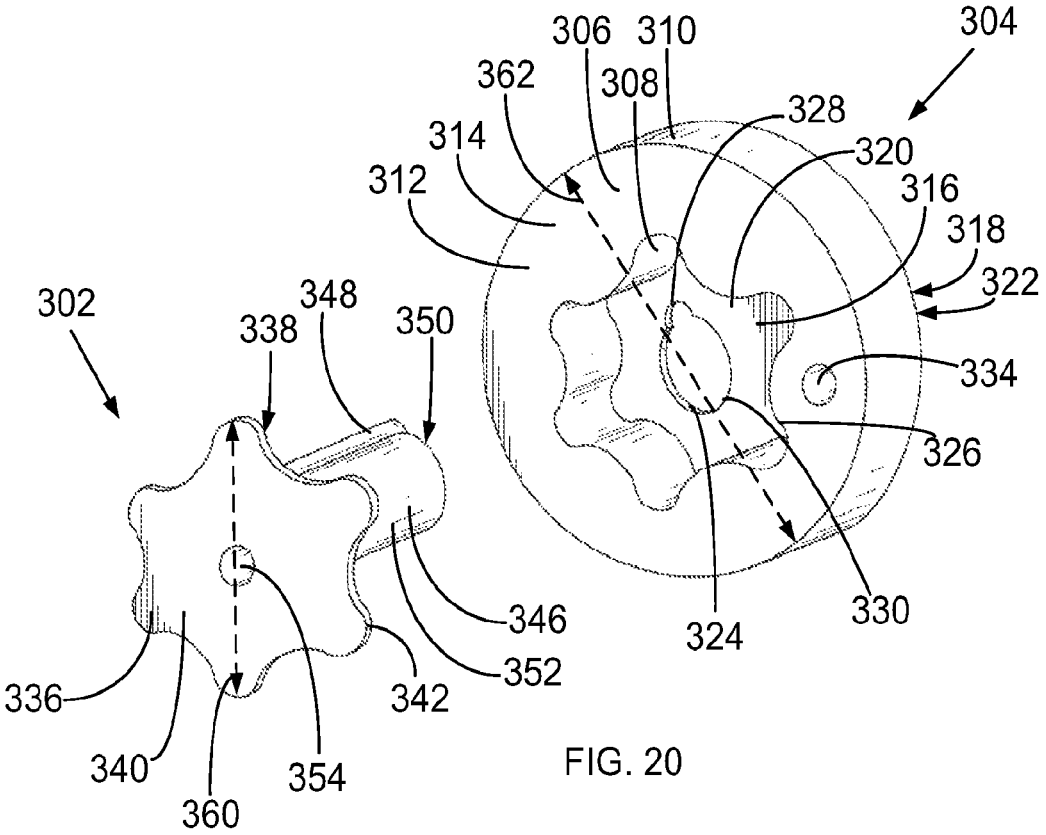
FIG. 20 is a perspective view of an inner member and an outer member that form the hollow inner rotor.

Referring now to FIG. 20, an inner member 302 and an outer member 304 used to form the hollow inner rotor 164 are shown. The inner and outer members 302 and 304 may be cast, molded, machined from larger blocks of a suitable material, such as steel, or otherwise formed by any other suitable method of construction.

The outer member 304 includes a ring portion, such as a wall portion 306 having an inner surface 308 and an outer surface 310. Disposed between and adjacent to the inner and outer surfaces 308 and 310 at a first axial end 312 of the wall portion 306 is a face surface 314. A faceplate portion 316 extends radially inwardly from a second axial end 318 of the wall portion 306. The faceplate portion 316 includes an inner surface 320, an outer surface 322, and an edge surface 324 disposed between the inner and outer surfaces 320 and 322. The faceplate portion 316 also includes a first opening 326 defined by the edge surface 324 and having a substantially circular profile including a notch groove 328. The notch groove 328 extends from the inner surface 320 to the outer surface 322. A second opening 330 defined by the inner surface 308 and having a cyclic profile, such as a substantially lobed or trochoidal profile, is provided at the first axial end 312 of the wall portion 306. An indexing passage 334 extends axially through the outer member 304 from the face surface 314 of the wall portion 306 to the outer surface 322 of the faceplate portion 316. The indexing passage 334 is shown as substantially cylindrical, but may be of any other suitable shape.

The inner member 302 includes a faceplate portion 336 having a cyclic profile, such as a substantially lobed or trochoidal profile, corresponding to the substantially lobed or trochoidal profile of the second opening 330 of the outer member 304. The faceplate portion 336 has an inner surface 338, an outer surface 340, and an edge surface 342 disposed between the inner and outer surfaces 338 and 340. A core portion 346 extends axially from the inner surface 338 of the faceplate portion 336. The core portion 346 has a substantially circular profile corresponding to the substantially circular profile of the first opening 326 of the outer member 304. The core portion has a notch 348 extending axially along the core portion 346 and corresponding to the notch groove 328 of the first opening 326. Additionally, the core portion 346 has a face surface 350 and an edge surface 352 disposed adjacent to the face surface 350. An indexing passage 354 extends axially through the inner member 302 from the outer surface 340 of the faceplate portion 336 to the face surface 350 of the core portion 346. The indexing passage 354 is shown as substantially cylindrical, but may be of any other suitable shape.

Figure 21:
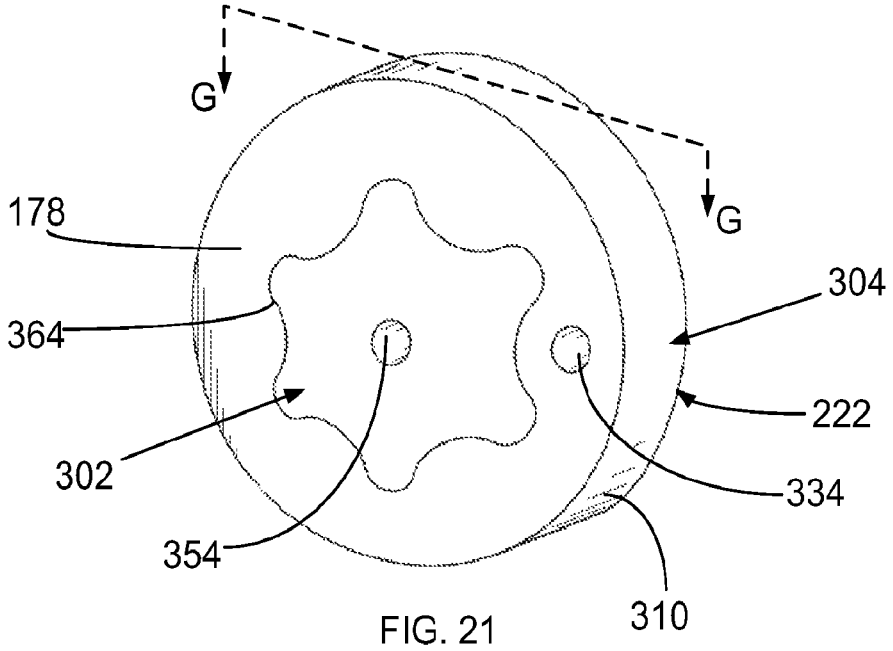
FIG. 21 is another perspective view of the inner and outer members of FIG. 20.

As shown in FIGS. 20 and 21, to form the hollow inner rotor 164, the inner member 302 is received at the outer member 304, such as inserted into the outer member 304, such that the substantially circular profile of the core portion 346 of the inner member 302 is received into the substantially lobed profile of the first opening 326 of the outer member 304. Further, the notch 348 of the core portion 346 is received into the notch groove 328 of the opening 326. The edge surface 324 of the faceplate portion 316 is disposed against the edge surface 352 of the core portion 346. The substantially lobed profile of the faceplate portion 336 is likewise received into the substantially lobed profile of the second opening 330 of the outer member 304. The edge surface 342 of the faceplate portion 336 is disposed against the inner surface 330 of the wall portion 306.

When the inner and outer members 302 and 304 are connected, the outer surface 340 of the faceplate portion 336 may be flush to or in the same plane as the face surface 314 and in combination may form one of the front face 178 or the rear face 222 of the hollow inner rotor 164. Likewise, the outer surface 320 may be flush to or in the same plane as the face surface 350 and in combination may form the other of the front face 178 or the rear face 222 of the hollow inner rotor 164. The outer surface 310 extends between the front and rear faces 178 and 222. Alternatively, depending on the outer diameter 360 of the faceplate portion 336 and the corresponding outer diameter 362 of the wall portion 306, the faceplate portion 336 may not be received into the second opening 330. Instead, the faceplate portion 336 may have a substantially circular profile, and the face surface 314 of the wall portion 306 may be disposed against the inner surface 338 of the faceplate portion 336 once the inner and outer members 304 and 302 are connected. In this case, the outer surface 310 and the edge surface 342 in combination may form an outer surface of the connected inner and outer members 302 and 304, and additional welding may be completed on the outer surface.

Figure 22:
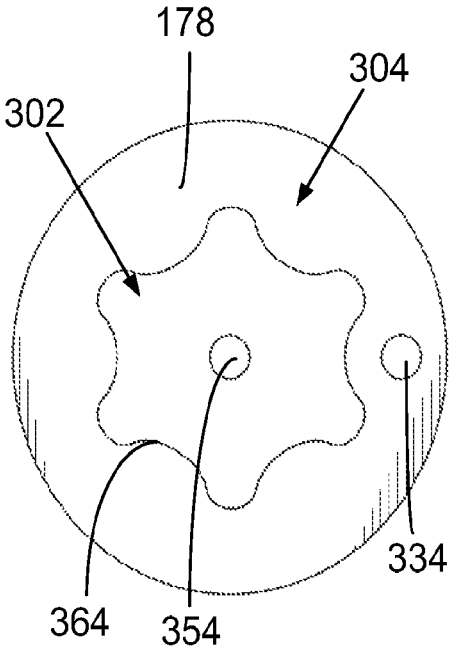
FIGS. 22 and 23 are front and rear views, respectively, of the inner and outer members of FIG. 20.
Figure 23:
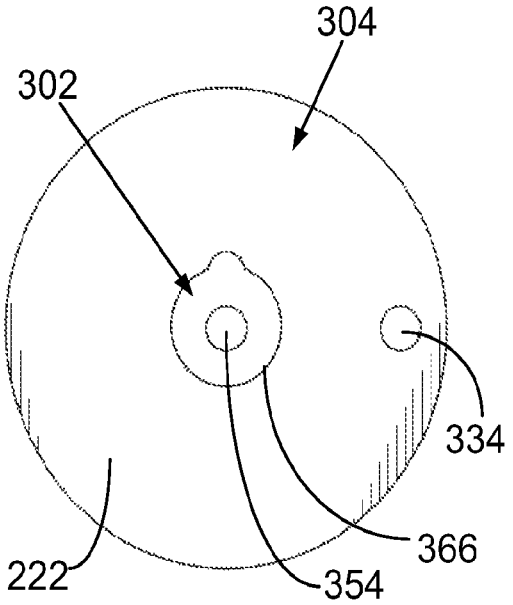

Turning now to FIGS. 21-23, an assembly including the inner and outer members 302 and 304 is shown. The assembly is substantially cylindrical and has a front face 178 and a rear face 222, which are the front and rear faces 178 and 222, respectively, of the hollow inner rotor 164. The outer surface 310 is disposed between the front and rear faces 178 and 222. The indexing passages 334 and 354 extend axially between the front and rear faces 178 and 222.

Once the inner and outer members are positioned as shown in FIG. 21, the members are connected at lines 364 and 366 to form a coupled assembly. The members may be coupled at lines 364 and 366 in any suitable manner, such as by welding (ultrasonic welding, induction welding, heat welding, friction welding, etc.), brazing, soldering, gluing, melting, bonding, etc. Additional machining, such as sanding or milling, of the surfaces of the assembly may also be completed. It will also be appreciated that other embodiments of the coupled assembly of the inner and outer members 302 and 304 may provide for connecting at lines different than or other than the lines 364 and 366.

Figure 24:
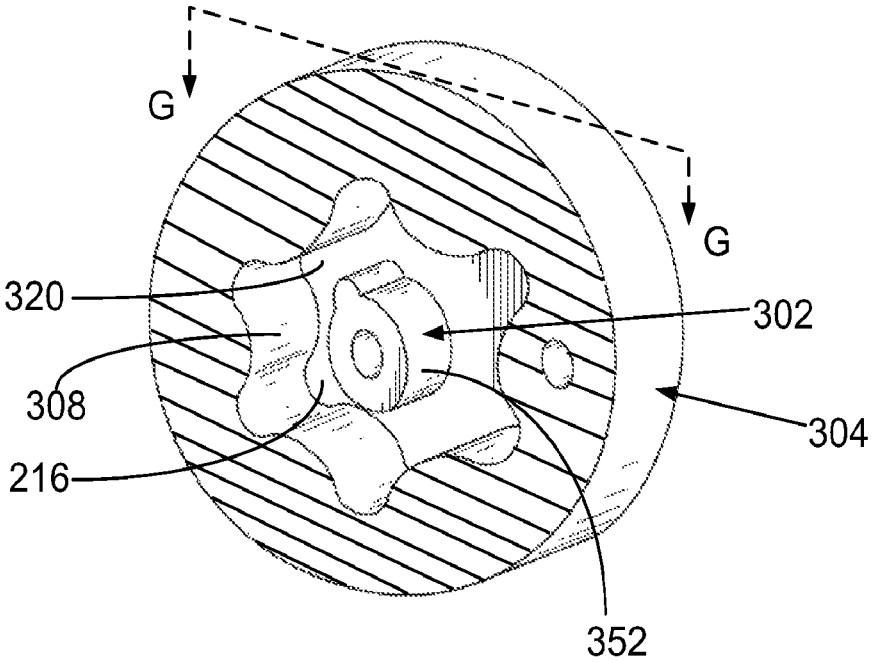
FIG. 24 is a cross-sectional view of the inner and outer members of FIG. 20.

When the inner and outer members are coupled together, the cavity 216 is provided as shown in the cross-section of FIG. 24 taken about line G-G in FIG. 21. The cavity is defined by the inner surface 320, the inner surface 308, the edge surface 352, and the inner surface 338 (not shown).

Figure 25:
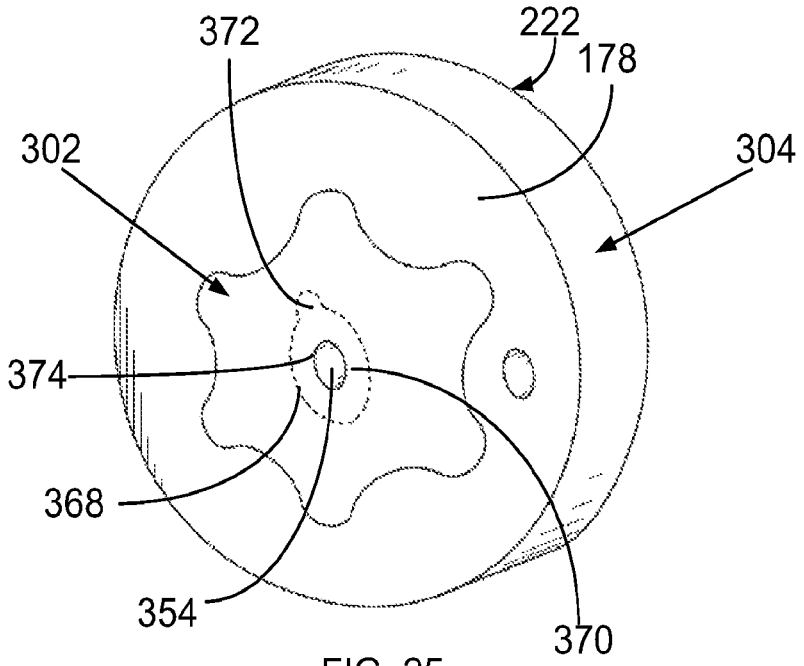
FIG. 25 is still another perspective view of the inner and outer members of FIG. 20.

Turning now to FIG. 25, a dotted line, such as cut line 368, is represented on the front face 178. The cut line 368 represents an outer profile of an inner portion 370 to be removed from the welded assembly. It will be appreciated that the cut line 368 may alternatively be represented on the rear face 222. The inner portion 370 is substantially circular in profile and extends axially between the front and rear faces 178 and 222. Additionally, the circular profile of the inner portion 370 includes a notch section 372. As shown, the profile of the inner portion 370 removed at the front face 178 is substantially the same as the profile of the inner portion 370 removed at the rear face 222. Alternatively, the profiles of the inner portion 370 removed at the front and rear faces 178 and 222 may be different. The removing may include milling, laser cutting, electrical discharge machining, wire electrical discharge machining, or any other suitable method of removing material.

In the case of wire electrical discharge machining, or wire-EDM, the cut line 368 is programmed, such as via computer numerically controlled programming or CNC programming, into a memory of a wire-EDM machine. A wire of the wire-EDM machine is passed through the indexing passage 354 such that the wire extends axially away from each of the front and rear faces 178 and 222. Accordingly, the wire-EDM process allows for uniform cuts to be made extending from the front face 178 to the rear face 222. A first cut may extend from an inner surface 374 of the indexing passage 354 to the cut line 368. Subsequent cuts may substantially follow the cut line 368 to thereby remove the inner portion 370.

Figure 26:
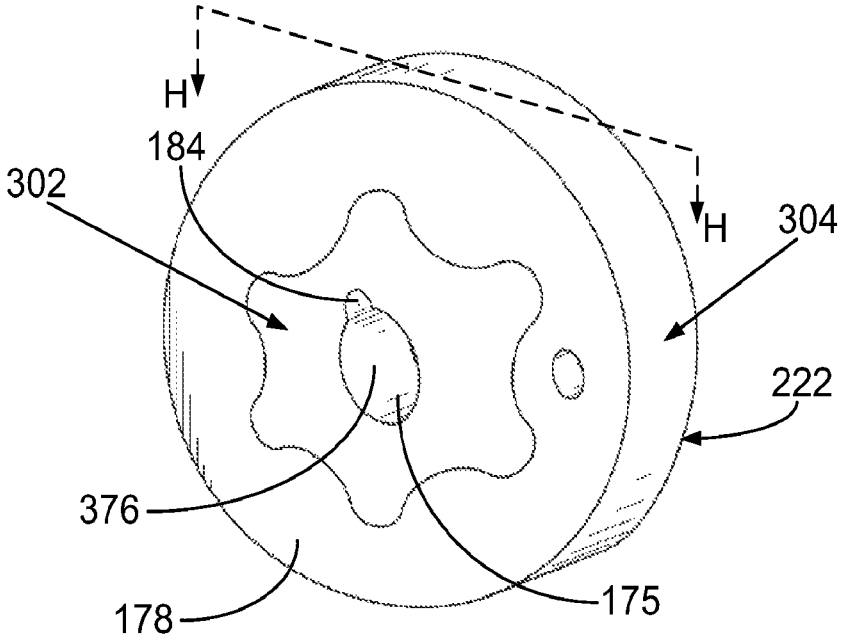
FIG. 26 is a perspective view of the inner and outer members of FIG. 20 after machining.

Referring next to FIG. 26, after the material 370 has been removed, the assembly has a substantially circular inner profile defined by the central opening 376. The central opening 376 extends axially between the front and rear faces 178 and 222 of the assembly and corresponds to an outer profile of the inner portion 370 that was removed from the assembly. The central opening 376 also includes the notch pocket 184, which corresponds to the notch profile 372 of the inner portion 370. Further, the notch pocket 184 of the central opening 376 is the notch pocket 184 of the hollow inner rotor 164. The resulting inner wall 175 defining the central opening 376 is the inner wall 175 of the hollow inner rotor 164.

Figure 27:
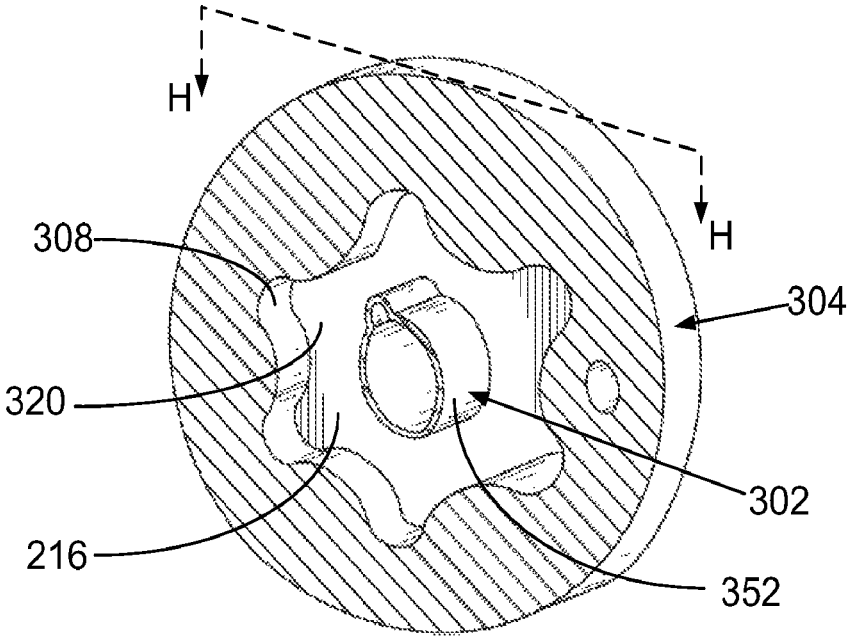
FIG. 27 is a cross-sectional view of the inner and outer members of FIG. 26.

Turning now to FIG. 27, the assembly is shown in cross-section taken about line H-H in FIG. 26. As shown at 216, the cavity is defined by the inner surface 320, the inner surface 308, the edge surface 352, and the inner surface 338 (not shown).

Figure 28:
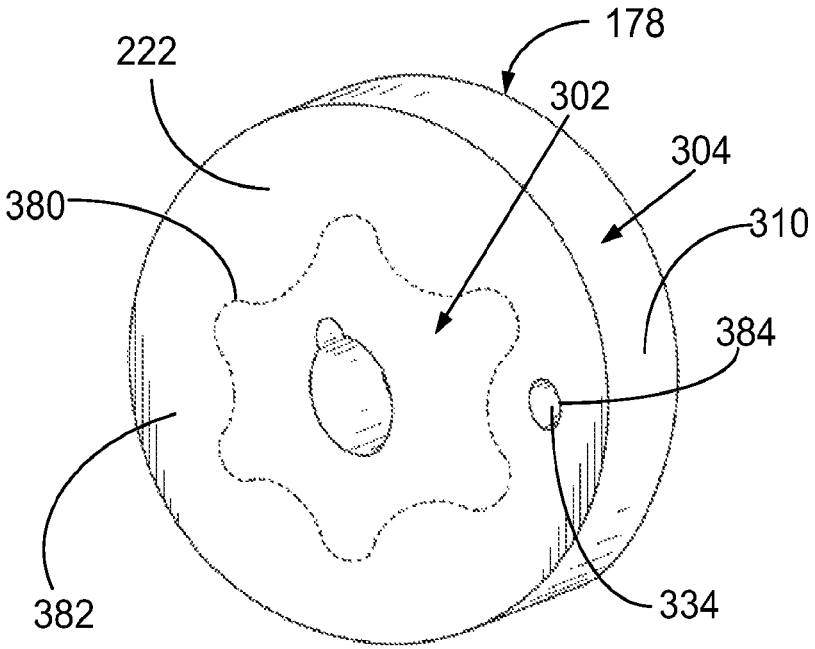
FIG. 28 is another perspective view of the inner and outer members of FIG. 26.

Referring next to FIG. 28, a dotted line, such as cut line 380, is represented on the rear face 222. The cut line 380 represents an inner profile of a cyclic profile, such as a substantially lobed profile, of an outer portion 382 to be removed from the assembly. It will be appreciated that the cut line 380 may alternatively be represented on the front face 178. The outer portion 382 to be removed extends axially between the front and rear faces 178 and 222. As shown, the profile of the outer portion 382 removed at the front face 178 is substantially the same as the profile of the outer portion 382 removed at the rear face 222. Alternatively, the profiles of the outer portion 382 removed and the front and rear faces 178 and 222 may be different. The removing may include milling, grinding, laser cutting, lathe cutting, electrical discharge machining, wire electrical discharge machining, etc. In the case of wire electrical discharge machining, or wire-EDM, the cut line 380 is programmed, as described above in reference to the cut line 368, where the wire may begin at the inner surface 384 of the indexing passage 334 and then may move to and substantially follow the cut line 380. Alternatively, the wire may begin at the outer surface 310 instead of at an indexing passage.

After removal of the outer portion 382, the resulting assembly is shown at FIGS. 6-8, described above. Thus, the resulting outer surface of the resulting assembly after removal of the outer portion 382 is defined by the substantially lobed cut line 380 and is the outer surface 189 of the hollow inner rotor 164. It should be appreciated that the above-described steps may be completed in any appropriate or suitable order that results in making the hollow inner rotor 164. Further, additional machining or welding, such as sanding or milling, of the surfaces of the assembly may also be completed.

Figure 29:
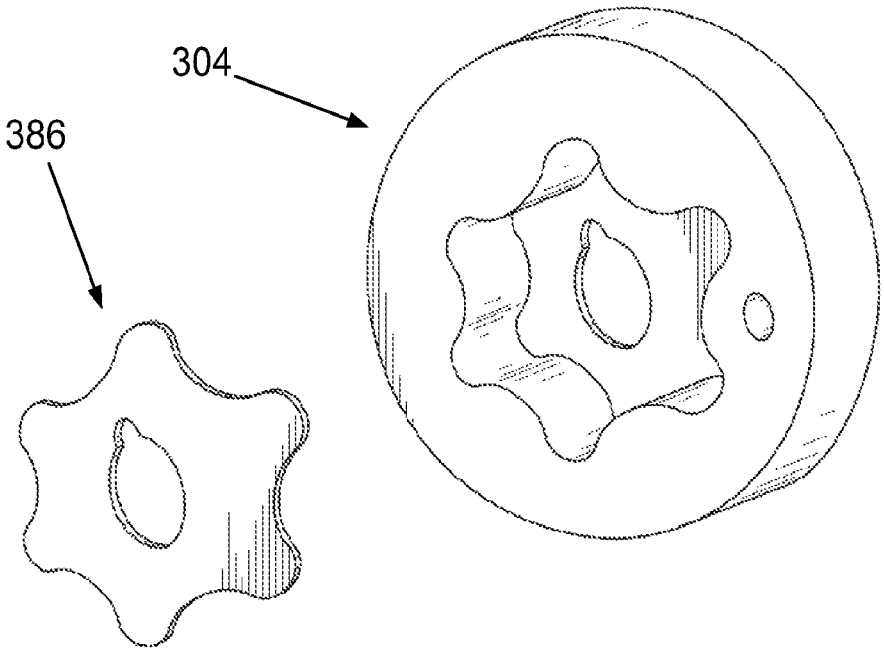
FIG. 29 is another perspective view of an inner member and an outer member of that form the hollow inner rotor.

Turning now to FIG. 29, the outer member 304 is shown with an inner member 386, the inner member 386 which is another embodiment of the inner member 302 of FIG. 20. Inner member 386 is substantially the same as inner member 302 of FIG. 20, except that it does not include the core portion 346 of the inner member 302. It will be appreciated that to form the hollow inner rotor 164, many of the same steps described with regards to FIGS. 20-28 may be followed, with the exception that an inner profile may not be removed. Accordingly, the resulting assembly is shown in cross-section in FIG. 9 at 230.

Although the invention has been shown and described with respect to a certain embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

What is claimed is:

1. A hollow rotor for a gerotor system, the hollow rotor comprising:

radially inner and outer walls radially spaced-apart in relation to a rotational axis of the hollow rotor, the radially inner and outer walls defining therebetween a continuous annular cavity, at least one of the radially inner and outer walls forming a plurality of lobes circumferentially spaced-apart around the continuous annular cavity; and axial end walls, wherein axial ends of the continuous annular cavity are closed by the axial end walls extending between and in connection with the radially inner and outer walls, so that the continuous annular cavity is enclosed on all sides to form a sealed enclosure.

2. The hollow rotor according to claim 1, wherein the hollow rotor is made of steel.

3. The hollow rotor according to claim 1, wherein the at least one of the radially inner or outer walls forming a plurality of circumferentially spaced-apart lobes is substantially trochoidal.

4. The hollow rotor according to claim 1, wherein the radially inner and outer walls are fixed to the axial end walls.

5. A gerotor system, comprising:

inner and outer rotors having respective lobed surfaces, the respective lobed surfaces for interengaging with one another, wherein at least one of the inner and outer rotors is the hollow rotor according to claim 1.

6. The gerotor system according to claim 5, wherein the inner and outer rotors are rotatable with respect to one another, thereby creating alternately expanding and contracting pockets between the interengaging lobed surfaces and providing for movement of fluid through the system.

7. The gerotor system according to claim 5, wherein the outer rotor is the hollow rotor, the inner wall of the outer rotor forming a plurality of circumferentially spaced-apart lobes.

8. The gerotor system according to claim 5, wherein the inner rotor is the hollow rotor, the outer wall of the inner rotor forming a plurality of circumferentially spaced-apart lobes.

9. The gerotor system according claim 5, wherein the inner rotor is a first hollow rotor and the outer rotor is a second hollow rotor, each of the first and second hollow rotors according to claim 1, and wherein the inner wall of the outer rotor forms a plurality of circumferentially spaced-apart lobes, and the outer wall of the inner rotor forms a plurality of circumferentially spaced-apart lobes.

10. The gerotor system according to claim 5, wherein a portion of the lobed surface of the inner rotor engages a portion of the lobed surface of the outer rotor while the gerotor system is active.

11. The gerotor system according to claim 5, wherein the inner rotor is axially located with respect to the outer rotor through a rolling or sliding interaction between the lobed surfaces of the inner and outer rotors.

12. The gerotor system according to claim 5, wherein the inner rotor rotates about a first axis and the outer rotor rotates about a second axis.

13. A gerotor system comprising:

an inner rotor and an outer rotor having respective lobed profiles for interengaging with one another, wherein the inner rotor is a hollow rotor and includes front and rear axial faceplate portions;

radially spaced-apart first and second ring portions extending between the front and rear faceplate portions, the first ring portion radially disposed about the second ring portion, wherein the first ring portion has a lobed profile; and a continuous annular cavity defined by interconnection of the first and second ring portions and the front and rear faceplate portions, thereby defining a sealed enclosure.

14. The gerotor system according to claim 13, wherein the outer rotor is a hollow rotor, having an inner wall having a lobed profile.

15. The gerotor system according to claim 13, wherein the front and rear axial faceplate portions of the inner rotor are fixed to the radially spaced-apart first and second ring portions of the inner rotor.

* * * * *